US006331928B1

(12) United States Patent
Grasso et al.

(10) Patent No.: US 6,331,928 B1
(45) Date of Patent: Dec. 18, 2001

(54) ESD-PROTECTED INTERFACE PANEL AND ASSOCIATED METHODS

(75) Inventors: Charles Grasso; David Patrick Tieben, both of Louisville, CO (US)

(73) Assignee: Storage Technology Corporation, Louisville, CO (US)

( * ) Notice: Subject to any disclaimer, the term of this patent is extended or adjusted under 35 U.S.C. 154(b) by 0 days.

(21) Appl. No.: 09/318,550

(22) Filed: May 27, 1999

(51) Int. Cl.[7] ..... H05F 3/02
(52) U.S. Cl. ..... 361/212; 361/220
(58) Field of Search ..... 174/32, 35 R, 174/35 GC, 35 MS, 256; 200/305, 512; 361/212, 220, 816

(56) References Cited

U.S. PATENT DOCUMENTS

| | | | | |
|---|---|---|---|---|
| 4,303,960 | | 12/1981 | Sherwood et al. . | |
| 4,375,585 | | 3/1983 | Lee . | |
| 4,786,767 | | 11/1988 | Kuhlman . | |
| 4,814,566 | * | 3/1989 | Sigl | 200/305 |
| 4,894,493 | | 1/1990 | Smith et al. . | |
| 5,063,474 | * | 11/1991 | Igarashi | 361/220 |
| 5,383,097 | * | 1/1995 | DeLucia et al. | 361/816 |

FOREIGN PATENT DOCUMENTS

| | | |
|---|---|---|
| 8527651 U | 12/1985 | (DE) . |
| 0 703 591 A | 3/1996 | (EP) . |
| 2 282 915 A | 4/1995 | (GB) . |
| 07307779 A | 11/1995 | (JP) . |

* cited by examiner

*Primary Examiner*—Fritz Fleming
(74) *Attorney, Agent, or Firm*—Duft, Graziano & Forest; Wayne P. Bailey

(57) ABSTRACT

The invention provides an ESD-protected interface panel. A signal board has one or more circuit layers and at least one button switch on a first side of the board. An electrical output (e.g., an electrical cable and/or connector) connects in circuit with the board and switch, and the signal board generates signals on the electrical output indicative of activation of the button switch. An ESD protection layer covers the button switch and substantially all of the first side. The ESD layer is deformable to human touch to activate the switch therethrough. The ESD layer electrically couples with one or more contacts covering at least part of the second side, such that ESD generated by the human touch is routed to chassis ground connected to the contacts. Preferably, the ESD layer bends around edges of the signal board to form the contacts in a single conductive layer. An indication layer, e.g., formed of polycarbonate material, preferably covers the ESD layer over the first side with embossed graphics over the button switch. The indication layer is deformable to human touch whereby pressing the embossed graphics deforms the indication layer, and thus the ESD protection layer, and activates the button switch therebelow. An adhesive (e.g., a double sided adhesive layer, or glue) covers at least part of the second side of the signal board, except for the contacts, so that the panel is easily bonded to electrical equipment, with the contacts coupling to chassis ground. The invention provides enhanced ESD protection even with various electrical components electrically coupled with the signal board, such as LEDs and other button switches, and further permits windowing through the panel to view directly the underlying electrical equipment.

11 Claims, 5 Drawing Sheets

ESD-PROTECTED INTERFACE PANEL AND ASSOCIATED METHODS

FIELD OF THE INVENTION

The invention relates to protection against electrostatic discharge caused by human touch with an interface panel.

BACKGROUND OF THE INVENTION

Electrostatic discharge ("ESD") is known to cause damage to electrical components and equipment. The prior art has developed certain ways to protect electrical equipment from human touch through specially designed user keypad panels. FIGS. 1 and 1A illustrate one such user keypad panel 10. Specifically, FIG. 1 shows a top view of keypad panel 10; and FIG. 1A shows a cross-sectional view of keypad panel 10. The upper-most layer of panel 10 is an embossed polycarbonate or polyester layer 11, which, for purpose of illustration, is shown transparent so as to view ESD screen layer 12. ESD screen layer 12 includes a silver-painted cross-hatch conductive pattern 12*a* that is connected to a conductive ESD tail 14. ESD tail 14 forms a mounting hole 16 used to electrically connect pattern 12*a* to equipment chassis.

FIG. 1A shows further detail of keypad panel 10, including button switch 18, button spacer layer 20, signal trace layer 22, and adhesive layer 23. Layer 11 includes an embossed button pattern 11*a*-illustratively shown as a dotted line in FIG. 1 and as an upward protrusion in FIG. 1A. Button pattern 11*a* is adjacent button switch 18 so that human pressure on embossed button pattern 11*a* activates button switch 18 through deformation of ESD screen layer 12. Button switch 18 is known in the art and operates with signal trace layer 22 to generate signals—via switch circuitry 22*a*—indicative of switch activation. These signals are detected in signal layer 22 by known techniques such as through signal cable 24. Spacer layer 20 is used to form a space between ESD layer 12 and signal trace layer 22. Adhesive layer 23 bonds panel 10 to a flat surface associated with electrical equipment.

Although keypad panel 10 is shown with only one button 11*a*, other buttons can be included. By way of example, button 11*a* can be a power on and power off button to the electrical equipment.

In operation, a user operates the electrical equipment through keypad panel 10. Screen layer 12*a* arguably attracts ESD pulses which are in turn shunted, through ESD tail 14, to chassis ground associated with the electrical equipment. ESD tail 14 is mounted to chassis ground with a screw and nut through mounting hole 16.

One problem with prior art panel 10 is that differential voltages can exist between lines of the cross-hatch pattern 12*a*, leaving residual voltage potential energy resident in ESD layer 12 even though other energy is drained off through ESD tail 14. Another problem is that panel 10 requires additional manufacturing cost and time due to ESD tail 14, and due to the nut and screw required to attach ESD tail 14 to chassis ground. Yet another problem is that ESD pulses are routed through a single location associated with panel 10, i.e., at ESD tail 14.

One object of the invention is to provide a new and improved ESD keypad panel that reduces or eliminates the above-described problems.

Another object of the invention is to provide an ESD protection panel with multiple ESD shunt contacts to improve grounding to equipment chassis.

Yet another object of the invention is to provide an ESD protection panel that has improved ESD protection capability, as compared to the prior art, and which requires less cost and manufacturing time.

Still another object of the invention is to provide an ESD-protected keyboard panel which has increased protection against ESD pulses coupling to associated electrical equipment.

These and other objects will become apparent in the description that follows.

SUMMARY OF THE INVENTION

In one aspect, the invention provides an ESD-protected interface panel. A signal board has one or more circuit layers and at least one button switch on a first side of the board. An electrical output connects in circuit with the board and switch, and the signal board generates signals on the electrical output indicative of activation of the button switch. An ESD protection layer covers the button switch and substantially all of the first side. The ESD layer is deformable to human touch to activate the switch therethrough. The ESD layer bends around at least one edge of the board to form one or more contacts covering at least part of the second side, such that ESD generated by the human touch is routed to chassis ground electrically connected to the contacts.

The invention also provides a method for protecting electrical equipment from ESD pulses generated by users at an interface panel, the interface panel of the type which includes a signal board with at least one button on a first side of the signal board for generating signals through the signal board in response to activation of the button switch, including the steps of: covering the button switch with an ESD layer that is deformable to human touch to activate the switch therethrough; and bending the ESD layer around at least one edge of the signal board to form one or more contacts covering at least part of a second side of the ESD board, wherein ESD generated by the human touch is routed to chassis ground connected to the contacts.

The invention is next described further in connection with preferred embodiments, and it will become apparent that various additions, subtractions, and modifications can be made by those skilled in the art without departing from the scope of the invention.

BRIEF DESCRIPTION OF THE DRAWINGS

A more complete understanding of the invention may be obtained by reference to the drawings, in which.

DETAILED DESCRIPTION OF THE DRAWINGS

Figure 1:
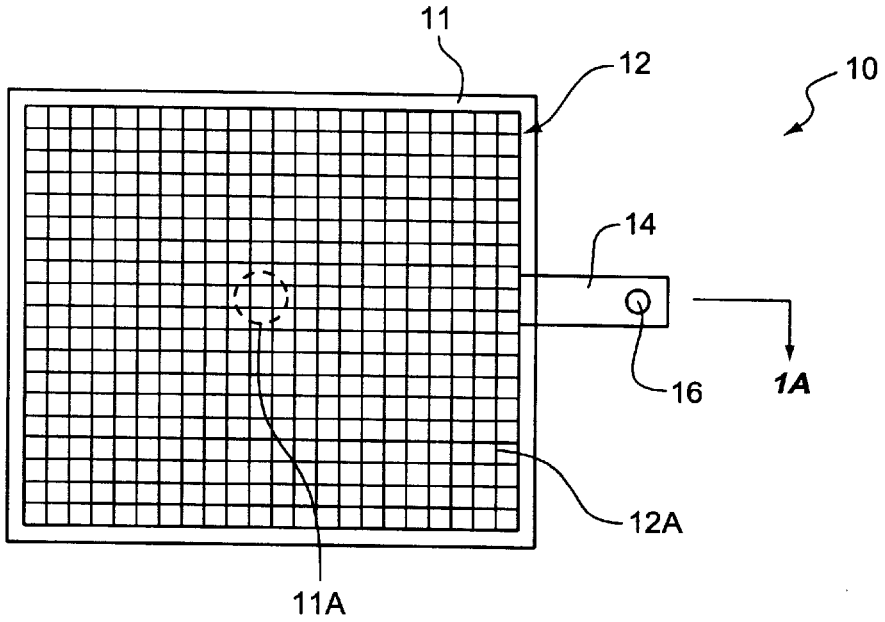
FIG. 1 PRIOR ART
FIGS. 1 and 1A schematically illustrate a prior art ESD keypad panel.
Figure 1A:
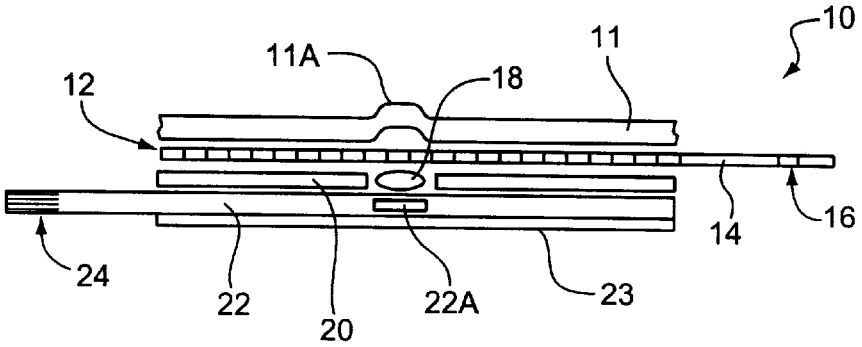

The invention provides an ESD-protected interface panel. A signal board has one or more circuit layers and at least one button switch on a first side of the board. An electrical output connects in circuit with the board and switch, and the signal board generates signals on the electrical output indicative of activation of the button switch. An ESD protection layer covers the button switch and substantially all of the first side. The ESD layer is deformable to human touch to activate the switch therethrough. The ESD layer bends around at least one edge of the board to form one or more contacts covering at least part of the second side, such that ESD generated by the human touch is routed to chassis ground electrically connected to the contacts. As an alternative, one or more of the contacts are separate from the ESD layer but electrically coupled thereto, providing an electrically integrated ESD layer with the contacts shunting ESD pulses to chassis ground, as above. In one aspect, the output includes an electrical cable. The output can also include an electrical connector.

In a preferred aspect, an indication layer covers the ESD layer over the first side. The indication layer has graphics indicative of the switch disposed below the indication layer and the ESD protection layer. The indication layer is deformable to human touch whereby pressing the graphics deforms the indication layer, and thus the ESD protection layer, and thus activates the button switch. The indication layer of one aspect is a polycarbonate layer. The indication layer of another aspect has embossing that forms the graphics. The indication layer of yet another aspect includes a polyester layer.

In another aspect, an indication layer covers the ESD layer over the first side, and the ESD layer and indication layer jointly form an aperture over the button switch such that a user can directly access the button switch through the indication layer. The button switch is formed of material such as rubber, silicon elastomer and/or silicon rubber.

The signal board of one aspect includes a LED on the first side connected in circuit with the signal board, such that the ESD protection layer forms an aperture over the LED so that the LED is seen. In one aspect, an indication layer covers at least part of the ESD layer over the first side. The indication layer forms a window adjacent the aperture such that a user can see the LED operating through the ESD layer.

In another aspect, an adhesive layer covers at least part of the second side without covering the contacts. Preferably, the adhesive layer has a first thickness and the ESD protection layer has a second thickness that is greater than the first thickness, such that placement of the panel on a flat surface ensures electrical connection between the contacts and the chassis ground associated with the flat surface. By way of example, the adhesive layer can have a thickness of approximately 0.002 inch and the ESD protection layer can have a thickness of approximately 0.003 inch. Preferably, the panel provides ESD protection to at least 25,000 Volts.

In yet another aspect, the signal board forms a first aperture for viewing through the panel. The ESD protection layer forms a second aperture substantially coincident with the first aperture. An indication layer covers the ESD layer over the first side. The indication layer indicates where the switch is disposed below the indication layer and ESD protection layer. The indication layer has a clear window substantially coincident with the first and second apertures to permit viewing through the panel. Preferably, an adhesive layer covers at least part of the second side without covering the contacts and the first aperture.

A signal board of one aspect includes a button circuit layer and an LED circuit layer. The button circuit layer facilitates operation of the button switch; and the LED circuit layer facilitates operation of an LED connected with the signal board. In one related aspect, the circuit layer includes a separate tail connecting the signal board to external electronics. A cable can be used to connect each circuit layer to external electronics.

Figure 2:
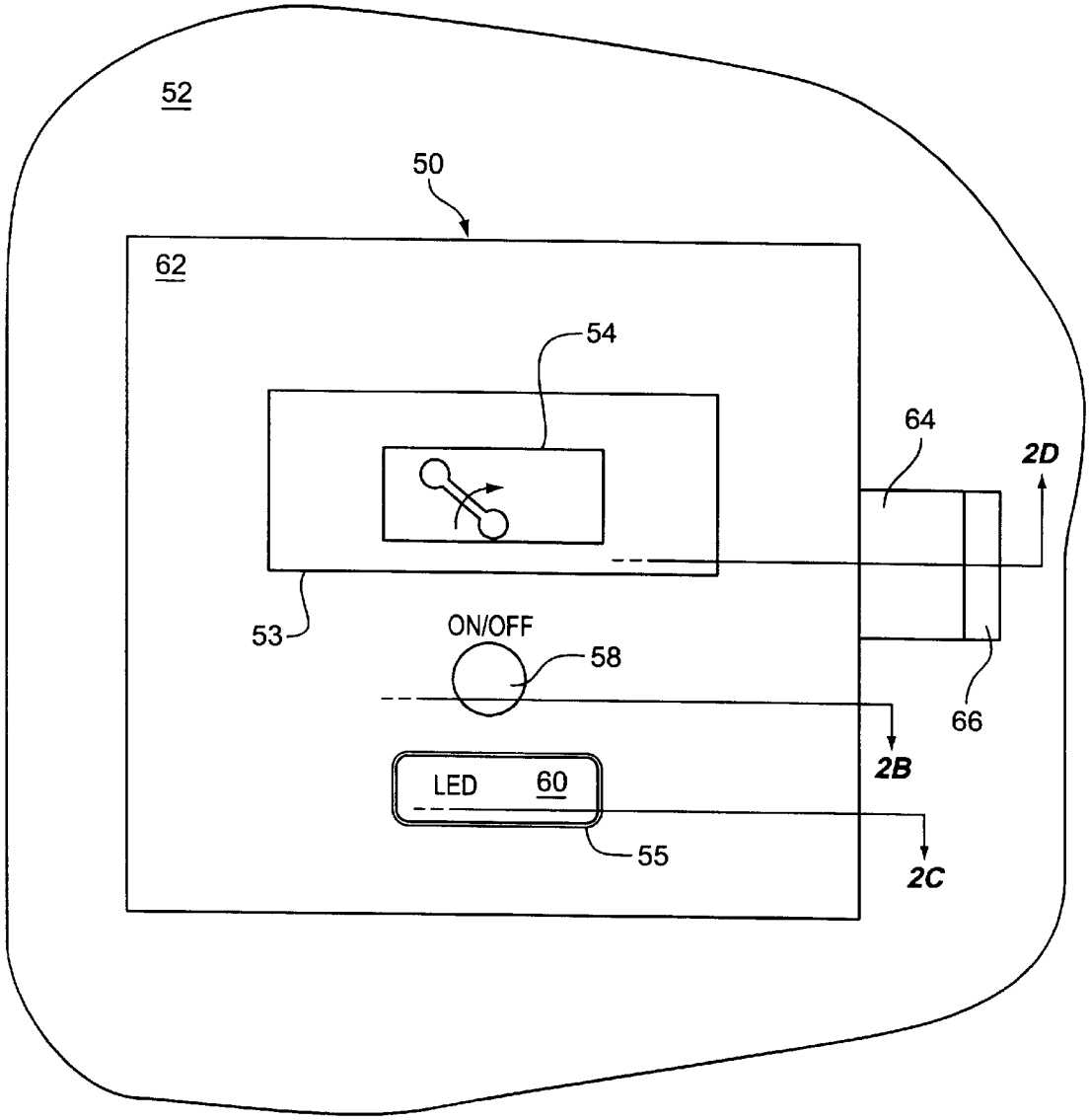
FIG. 2 schematically illustrates a front view of an ESD protection panel constructed according to the invention.

FIG. 2 schematically illustrates a front view of one ESD protection panel 50 of the invention. Panel 50 connects to electrical equipment 52 so that a user can interface with equipment 52 while protecting equipment 52 from ESD pulses. As illustrated, panel 50 has a window 53 permitting viewing of underlying instrumentation 54 (here shown as an electrical gauge) through panel 50. Panel 50 also has an ON/OFF button 58 and an LED 60 indicating when equipment 52 is ON or OFF relative to operation of button 58. The indication layer 62 of panel 50 is preferably a polycarbonate layer that is embossed to form graphics indicative of button 58. Those skilled in the art should appreciate that other material can be used for layer 62, including polyester; and also that button 58 can be formed by stenciled or ink graphics as alternatives to embossing. Indication layer 62 preferably has a window 55 arranged coincident with LED 60 so that LED light passes through layer 62.

Panel 50 includes an electrical cable 64 and connector 66 used to obtain signals from panel 50, and in particular from the signal board (not shown in FIGS. 2 and 2A) discussed below.

Figure 2A:
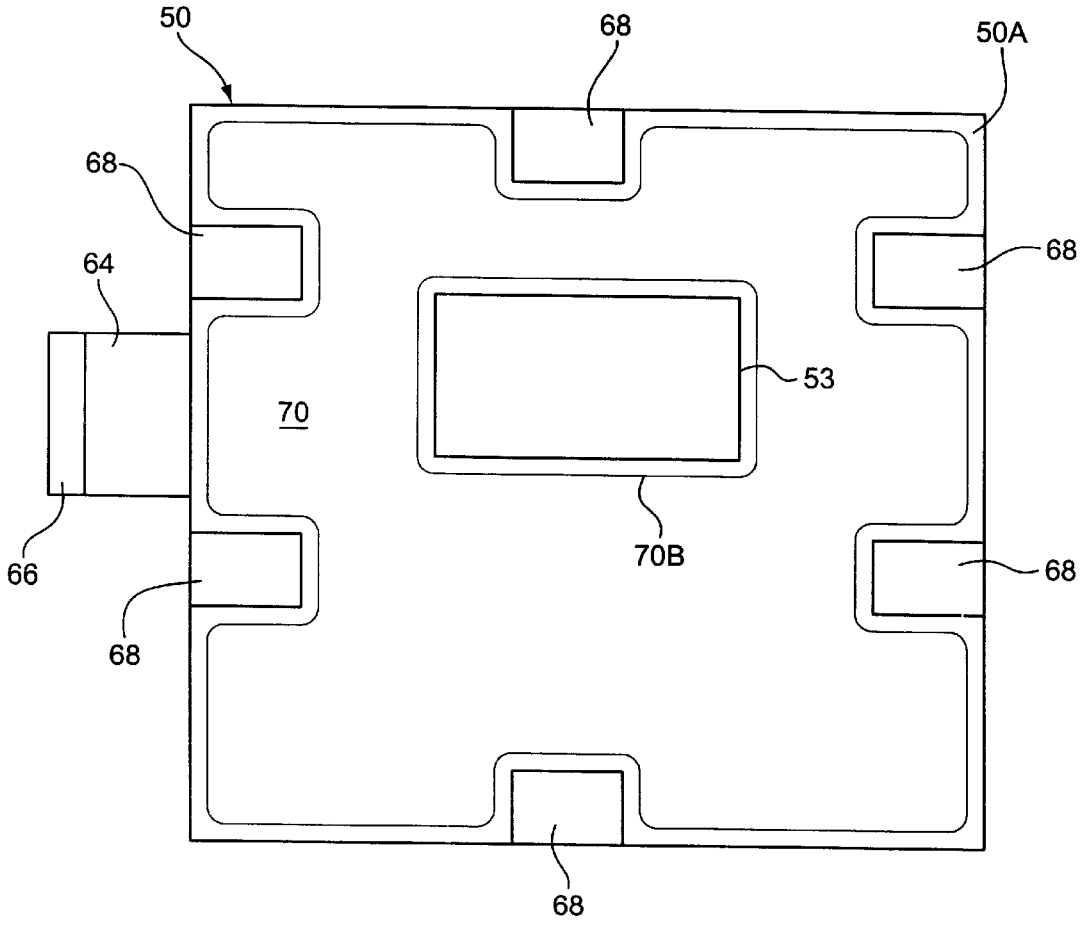
FIG. 2A shows a back view of the ESD protection panel of FIG. 2.

FIG. 2A illustrates a back side 50*a* of panel 50, including a plurality of electrical contacts 68 that integrally connect to the ESD layer (not shown in FIGS. 2 and 2A) discussed below. Electrical adhesive 70 bonds panel 50 to electrical equipment 52, FIG. 2, such that contacts 68 are electrically coupled to chassis ground associated with equipment 52. In this way, ESD pulses generated by human touch to button 58, for example, are shunted to chassis ground through contacts 68.

Those skilled in the art should appreciate that adhesive 70 can be applied accurately and geometrically to the back 50*a* of panel 50, by known techniques. Adhesive 70 is preferably applied to back 50*a* without covering any part of contacts 68 to ensure good electrical connection between contacts 68 and chassis ground.

Figure 2B:
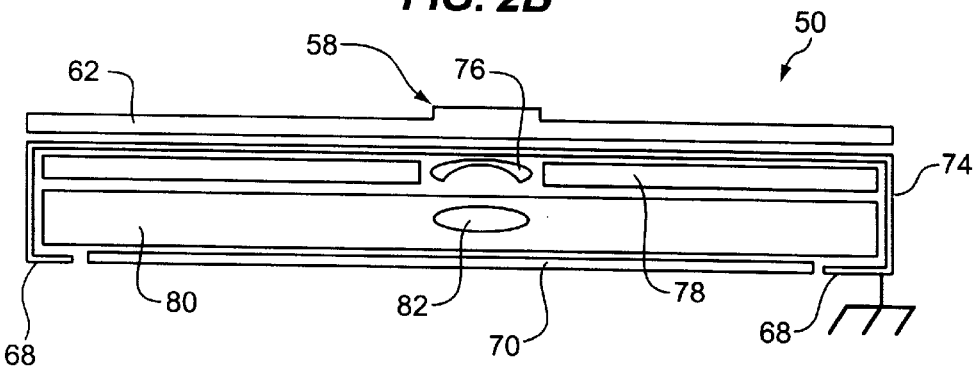
FIG. 2B shows a cross-sectional view of the panel of FIG. 2 through a button switch to illustrate the invention in comparison to the prior art embodiment of FIG. 1A.

FIG. 2B shows a cross-sectional view of panel 50 through button 58. As shown, button 58 is formed into indication layer 62 of panel 50 by embossing. ESD layer 74 resides below layer 62 to shunt ESD pulses to contacts 68. Button switch 76 and button spacer layer 78 reside below ESD layer 74, as shown. Signal board 80 communicates electronic signals indicative of button switch operation as generated by switch circuitry 82. Adhesive layer 70 bonds panel 50 to electrical equipment 52.

ESD layer 74 thus forms a protective ESD shield between layer 62 and button switch 76. When a user presses button 58, ESD layer 74 deforms to activate button switch 76; however ESD pulses are shunted to contacts 68, coupled to chassis ground.

Figure 2C:
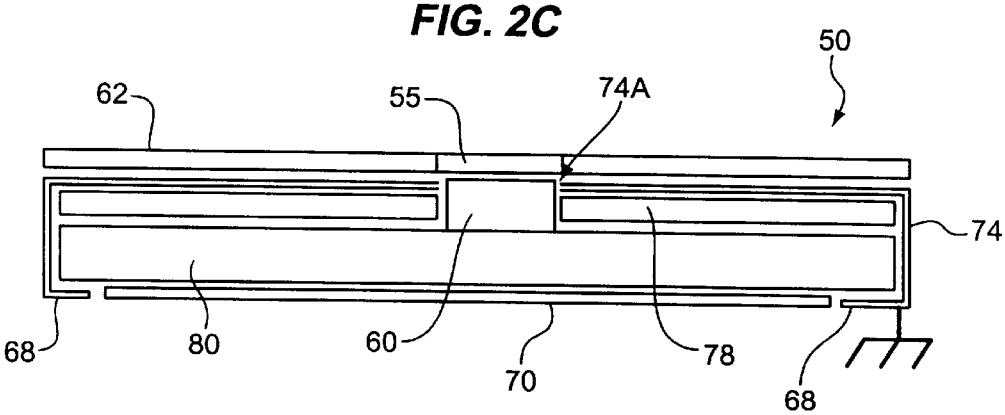
FIG. 2C shows a cross-sectional view of the panel of FIG. 2 through an LED.

FIG. 2C shows a cross-sectional view of panel 50 through LED60 and window 55. Window 55 is formed into indication layer 62 of panel 50 through known techniques. As above, ESD layer 74 below layer 62 shunts ESD pulses to contacts 68. ESD layer 74 forms an aperture 74*a* through which LED 60 protrudes. Signal board 80 communicates electronic signals to facilitate operation of LED 60 by known techniques.

Figure 2D:
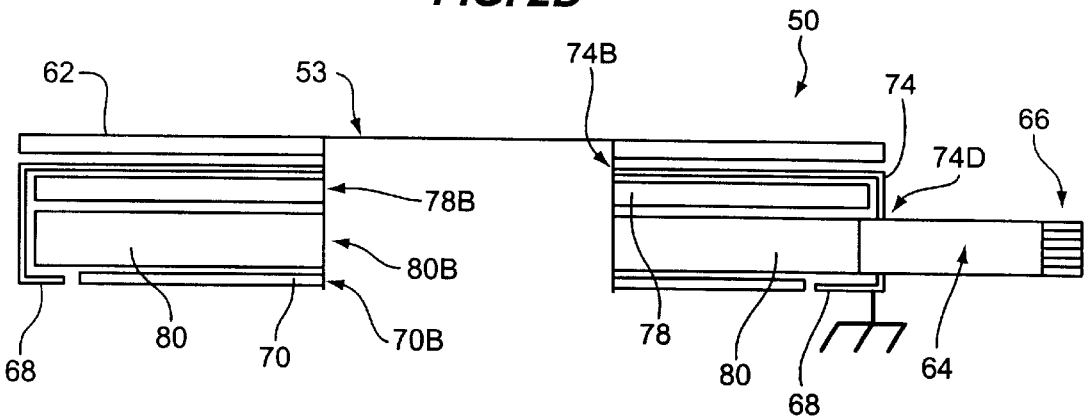
FIG. 2D shows a cross-sectional view of the panel of FIG. 2 through a window permitting viewing through the panel to underlying electrical equipment.

FIG. 2D shows a cross-sectional view of panel 50 through window 53 and cable and connector 64, 66. Window 53 permits viewing of instrumentation 54 associated with equipment 52, as shown. To form window 53, ESD layer 74 forms a corresponding aperture 74*b* through ESD layer 74 to permit viewing therethrough. Further, signal board 80 and button layer 78 form similar apertures 80*b*, 78*b*, respectively, for the same purpose. Adhesive 70 also thus preferably forms an aperture 70*b*.

FIG. 2D also illustrates connection between cable 64 and connector 66 to signal board 80 through ESD aperture 74*d*.

Figure 3:
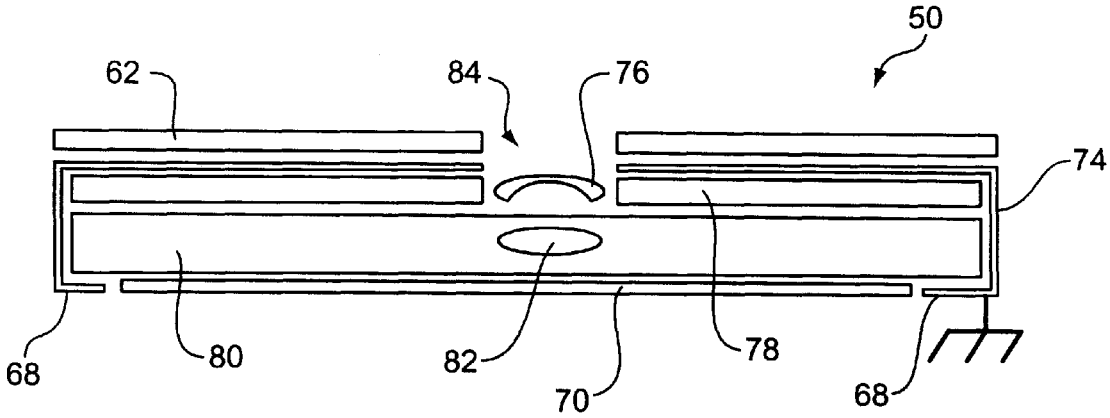
FIG. 3 shows a cross-sectional view of the panel of FIG. 2 with the ESD layer and indication layer each forming an aperature over the button switch such that a user can directly access the button switch through the indication layer.

In an alternate embodiment, as shown in FIG. 3, indication layer 62 covers the ESD layer 74 over the first side, and the ESD layer 74 and indication layer 62 jointly form an aperture 84 over the button switch 76 such that a user can directly access the button switch 76 through the indication layer 62.

The invention also provides a method for protecting electrical equipment from ESD pulses generated by users at an interface panel, the interface panel of the type which includes a signal board with at least one button on a first side of the signal board for generating signals through the signal board in response to activation of the button switch, including the steps of: covering the button switch with an ESD layer that is deformable to human touch to activate the switch therethrough; and bending the ESD layer around at least one edge of the signal board to form one or more contacts covering at least part of a second side of the ESD board, wherein ESD generated by the human touch is routed to chassis ground connected to the contacts.

In other aspects, the method includes the steps of (a) covering the first side of the ESD layer with an indication layer and (b) providing graphics in the indication layer indicative of the button switch disposed below the indication layer and the ESD protection layer, such that deformation of the indication layer graphics in response to human touch activates the button switch. The graphics are preferably embossed into the indication layer.

The method of one aspect includes the further steps of attaching the second side of the signal board to the electrical equipment via an adhesive layer covering part of the second side, without covering the contacts, and electrically coupling the contacts to the chassis ground.

The invention thus attains the objects set forth above, among those apparent from preceding description. Since certain changes may be made in the above systems and methods without departing from the scope of the invention, it is intended that all matter contained in the above description or shown in the accompanying drawing be interpreted as illustrative and not in a limiting sense.

In view of the foregoing, what is claimed is:

What is claimed is:

1. An ESD-protected interface panel, comprising:

a signal board comprising a first and second side; and an ESD protection layer covering substantially all of the first side and extending around at least one edge of the signal board to form at least one contact covering at least part of the second side, wherein chassis ground is connected to the at least one contact, the ESD protection layer being deformable to human touch to activate an underlying switch coupled to the signal board.

2. The panel of claim 1, further comprising an indication layer covering at least a portion of the ESD protection layer over the first side, the indication layer having graphics indicative of a switch disposed below the indication layer and the ESD protection layer, the indication layer being deformable to human touch to activate the switch by pressing the indication layer and thus the switch.

3. The panel of claim 1, further comprising an indication layer covering at least a portion of the ESD protection layer over the first side, wherein the ESD protection layer and indication layer each form an aperture over a switch on the signal board such that a user can directly access the switch through the indication layer.

4. The panel of claim 1, wherein the signal board further comprises a LED on the first side of the signal board, wherein the ESD protection layer forms an aperture over the LED such that the LED is seen.

5. The panel of claim 4, further comprising an indication layer covering at least part of the ESD protection layer over the first side, the indication layer forming a window adjacent the aperture such that a user can see the LED operating through the ESD protection layer.

6. The panel of claim 1, further comprising an adhesive layer covering at least part of the second side.

7. The panel of claim 6, wherein the adhesive layer has a first thickness and wherein the ESD protection layer has a second thickness that is greater than the first thickness, wherein placement of the panel on a flat surface ensures electrical connection between the at least one contact and chassis ground associated with the flat surface.

8. The panel of claim 1, wherein the signal board forms a first aperture for viewing through the panel, the ESD protection layer forming a second aperture substantially coincident with the first aperture, and further comprising an indication layer substantially covering the ESD protection layer over the first side, the indication layer indicating a switch disposed below the indication layer and ESD protection layer, the indication layer having a clear window substantially coincident with the first and second apertures to permit viewing through the panel.

9. A method for protecting electrical equipment from ESD pulses generated by users at an interface panel, the interface panel of a type which includes a signal board with at least one switch on a first side of the signal board for generating signals through the signal board in response to activation of the switch, comprising the steps of:

covering the switch with an ESD protection layer that is deformable to human touch to activate the switch therethrough; and bending the ESD protection layer around at least one edge of the signal board to form at least one contact covering at least part of a second side of the signal board, wherein ESD generated by the human touch is routed to chassis ground connected to the at least one contact.

10. The method of claim 9, further comprising the steps of covering the first side of the ESD protection layer with an indication layer, wherein deformation of the indication layer in response to human touch activates the switch.

11. The method of claim 9, further comprising the steps of attaching the second side of the signal board to the electrical equipment via an adhesive layer covering at least a portion of the second side and electrically coupling the at least one contact to the chassis ground.

* * * * *